US012799613B2

(12) United States Patent
Kim et al.

(10) Patent No.: US 12,799,613 B2
(45) Date of Patent: Nov. 17, 2026

(54) METHOD OF MANUFACTURING ELECTRODE FOR ELECTROLYSIS

(71) Applicant: LG Chem, Ltd., Seoul (KR)

(72) Inventors: Myung Hun Kim, Daejeon (KR); Hee Jun Eom, Daejeon (KR); Dong Chul Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 818 days.

(21) Appl. No.: 18/023,905

(22) PCT Filed: Nov. 12, 2021

(86) PCT No.: PCT/KR2021/016558
§ 371 (c)(1),
(2) Date: Feb. 28, 2023

(87) PCT Pub. No.: WO2022/114626
PCT Pub. Date: Jun. 2, 2022

(65) Prior Publication Data

US 2023/0243053 A1 Aug. 3, 2023

(30) Foreign Application Priority Data

Nov. 24, 2020 (KR) ..... 10-2020-0159200

(51) Int. Cl.
*C25B 11/097* (2021.01)
*C25B 11/061* (2021.01)

(52) U.S. Cl.
CPC ..... *C25B 11/097* (2021.01); *C25B 11/061* (2021.01)

(58) Field of Classification Search
CPC ..... H01M 4/625; C25B 1/46; C25B 11/097
See application file for complete search history.

(56) References Cited

U.S. PATENT DOCUMENTS

| | | | |
|---|---|---|---|
| 2008/0100195 | A1 | 5/2008 | Kim et al. |
| 2021/0140058 | A1 | 5/2021 | Eom et al. |
| 2022/0018032 | A1 | 1/2022 | Eom et al. |

FOREIGN PATENT DOCUMENTS

| | | | | | |
|---|---|---|---|---|---|
| CN | 107527752 | A | | 12/2017 | |
| CN | 109790634 | A | | 5/2019 | |
| CN | 110518218 | A | | 11/2019 | |
| CN | 111304658 | A | | 6/2020 | |
| EP | 3492631 | A1 | * | 6/2019 | ..... C25B 1/46 |
| JP | 2003277967 | A | | 10/2003 | |
| KR | 100822206 | B1 | | 4/2008 | |
| KR | 20110072917 | A | * | 6/2011 | ..... H01M 4/625 |
| KR | 20190073914 | A | | 6/2019 | |
| KR | 20200005463 | A | | 1/2020 | |
| KR | 20200007306 | A | | 1/2020 | |
| KR | 20200042787 | A | | 4/2020 | |
| KR | 2020-0076275 | A | | 6/2020 | |
| KR | 20200084261 | A | | 7/2020 | |
| KR | 20200102845 | A | | 9/2020 | |
| WO | 2020171509 | A1 | | 8/2020 | |

OTHER PUBLICATIONS

International Search Report for Application No. PCT/KR2021/016558 mailed Feb. 18, 2022, pp. 1-3.
Extended European Search Report including Written Opinion for Application No. 21898452.4dated Sep. 9, 2024, pp. 1-7.

* cited by examiner

*Primary Examiner* — Dah-Wei D. Yuan
*Assistant Examiner* — Andrew J Bowman
(74) *Attorney, Agent, or Firm* — Lerner David LLP

(57) ABSTRACT

A method for manufacturing an electrode for electrolysis, which includes applying a coating composition on at least one surface of a metal substrate, and drying and heat-treating the metal substrate applied with the coating composition to form a coating layer, in which urea and octadecylamine are both used in the coating composition to improve the durability and performance of an electrode for electrolysis to be manufactured.

8 Claims, No Drawings

METHOD OF MANUFACTURING ELECTRODE FOR ELECTROLYSIS

CROSS-REFERENCE TO RELATED APPLICATIONS

The present application is a national phase entry under 35 U.S.C. § 371 of International Application No PCT/KR2021/016558, filed on Nov. 12, 2021, which claims the benefit of Korean Patent Application No. 10-2020-0159200, filed on Nov. 24, 2020, the disclosures of which are incorporated herein in their entirety by reference.

TECHNICAL FIELD

The present invention relates to a method for manufacturing an electrode for electrolysis exhibiting low overvoltage properties and having excellent durability.

BACKGROUND ART

A technology of producing hydroxides, hydrogen, and chlorine by electrolyzing low-cost brine such as seawater is widely known. Such an electrolysis process is also referred to as a chlor-alkali process, the performance and reliability of which have been proven through decades of commercial operation.

As a method for electrolyzing brine, an ion exchange membrane method is currently most widely used, in which an ion exchange membrane is installed inside an electrolyzer to divide the electrolyzer into a cation chamber and an anion chamber, and brine is used as an electrolyte to obtain chlorine gas from an anode and hydrogen and caustic soda from a cathode.

Meanwhile, the electrolysis of brine is achieved through a reaction as shown in the following electrochemical reaction formula.

$$2Cl^- \rightarrow Cl_2 + 2e^- (E^\circ = +1.36V) \quad \text{Reaction in anode:}$$

$$2H_2O + 2e^- \rightarrow 2OH^- + H_2 (E^\circ = -0.83V) \quad \text{Reaction in cathode:}$$

$$2Cl^- + 2H_2O \rightarrow 2OH^- + Cl_2 + H_2 (E^\circ = -2.19V) \quad \text{Entire reaction:}$$

In performing the electrolysis of brine, the electrolytic voltage must be determined by taking the voltage theoretically required for the electrolysis of brine, the overvoltage of an anode, the overvoltage of a cathode, the voltage by the resistance of an ion exchange membrane, and the voltage by distance between the anode and the cathode into account. Among the above voltages, the overvoltage by an electrode acts as an important variable.

Therefore, methods capable of reducing the overvoltage of an electrode have been studied, and in particular, research has been actively conducted on how to configure components of an electrode coating layer, as well as what coating compositions to use in a manufacturing process of an electrode, and under what conditions to form a coating layer to manufacture an excellent electrode.

DISCLOSURE OF THE INVENTION

Technical Problem

An aspect of the present invention provides a method for manufacturing an electrode for electrolysis, the method capable of improving the durability and overvoltage properties of a finally manufactured electrode for electrolysis by optimizing the types and ratios of stabilizers used in a coating composition for forming a coating layer.

Technical Solution

According to an aspect of the present invention, there is provided a method for manufacturing an electrode for electrolysis.

(1) The present disclosure provides a method for manufacturing an electrode for electrolysis, the method including applying a coating composition on at least one surface of a metal substrate, and drying and heat-treating the metal substrate applied with the coating composition to form a coating layer, wherein the coating composition includes a ruthenium precursor and a stabilizer, wherein the stabilizer includes urea and octadecylamine.

(2) In (1) above, the present technology provides a method for manufacturing an electrode for electrolysis, wherein the urea and the octadecylamine are included at a molar ratio of 90:10 to 10:90.

(3) In (1) or (2) above, the present technology provides a method for manufacturing an electrode for electrolysis, wherein the urea and the octadecylamine are included at a molar ratio of 80:20 to 60:40.

(4) In any one of (1) to (3) above, the present technology provides a method for manufacturing an electrode for electrolysis, wherein the ruthenium precursor and the stabilizer are included at a molar ratio of 100:20 to 100:40.

(5) In any one of (1) to (4) above, the present technology provides a method for manufacturing an electrode for electrolysis, wherein the coating composition further includes a cerium precursor.

(6) In any one of (1) to (5) above, the present technology provides a method for manufacturing an electrode for electrolysis, wherein the coating composition further includes a platinum precursor.

(7) In any one of (1) to (6) above, the present technology provides a method for manufacturing an electrode for electrolysis, wherein a solvent of the coating composition is a mixture of isopropyl alcohol and 2-butoxy ethanol.

(8) In any one of (1) to (7) above, the present technology provides a method for manufacturing an electrode for electrolysis, wherein the applying, drying, and heat-treating are repeatedly performed such that the content of a ruthenium oxide is 7 $g/m^2$ or greater per unit area of the electrode for electrolysis.

(9) In any one of (1) to (8) above, the present technology provides a method for manufacturing an electrode for electrolysis, wherein the drying is performed for 5 minutes to 60 minutes at 50° C. to 300° C.

(10) In any one of (1) to (9) above, the present technology provides a method for manufacturing an electrode for electrolysis, wherein the heat-treating is performed for 1 hour or less at 400° C. to 600° C.

Advantageous Effects

An electrode for electrolysis manufactured by the manufacturing method of the present technology may exhibit low overvoltage and excellent durability.

MODE FOR CARRYING OUT THE INVENTION

Hereinafter, the present invention will be described in more detail.

It will be understood that words or terms used in the specification and claims of the present invention shall not be construed as being limited to having the meaning defined in commonly used dictionaries. It will be further understood that the words or terms should be interpreted as having meanings that are consistent with their meanings in the context of the relevant art and the technical idea of the invention, based on the principle that an inventor may properly define the meaning of the words or terms to best explain the invention.

Method for Manufacturing Electrode for Electrolysis

Research on lowering the overvoltage of an electrode during an electrolysis process has been continued, and as a part of the endeavor, research on a method for stably forming a coating layer by adding various components to a coating composition used in the formation of the coating layer is being actively conducted. As a representative example, it is known that when a compound having an amine group is added to a coating composition, the structure of a coating layer to be formed may be optimized to improve the performance of an electrode for electrolysis to be finally manufactured. However, even when a compound having an amine group is used, depending on a specific chemical structure or specific physical/chemical properties of the compound, a method used in a manufacturing process, or the performance of an electrode for electrolysis to be finally manufactured may vary.

Therefore, the inventor of the present invention has conducted research to develop a coating composition additive which may maximize the performance of an electrode to be manufactured, in terms of overvoltage properties and durability of an electrode, and has derived the present invention as a result of the research.

Specifically, the present disclosure provides a method for manufacturing an electrode for electrolysis, the method including applying a coating composition on at least one surface of a metal substrate, and drying and heat-treating the metal substrate applied with the coating composition to form a coating layer, wherein the coating composition includes a ruthenium precursor and a stabilizer, wherein the stabilizer includes urea and octadecylamine.

In the method for manufacturing an electrode for electrolysis of the present technology, a metal substrate to be applied with a coating composition may be nickel, titanium, tantalum, aluminum, hafnium, zirconium, molybdenum, tungsten, stainless steel, or an alloy thereof, and among the above, nickel is preferable. In addition, the metal substrate may be in the form of mesh or an expanded metal. When a metal substrate satisfying the above-described conditions is used, the durability of an electrode for electrolysis finally manufactured may be excellent, and the electrolysis performance may also be excellent.

In the method for manufacturing an electrode for electrolysis of the present technology, a coating composition for forming a coating layer includes a ruthenium precursor and a stabilizer. The ruthenium precursor is to form a ruthenium oxide in a coating layer, and may be a hydrate, a hydroxide, a halide or an oxide of ruthenium, and may be, specifically, one or more selected from the group consisting of ruthenium hexafluoride ($RuF_6$), ruthenium (III) chloride ($RuCl_3$), ruthenium (III) chloride hydrate ($RuCl_3 \cdot xH_2O$), ruthenium (III) bromide ($RuBr_3$), ruthenium (III) bromide hydrate ($RuBr_3 \cdot xH_2O$), ruthenium iodide ($RuI_3$), and an acetic acid ruthenium salt. When any of the above-listed ruthenium precursors is used, a ruthenium oxide may be easily formed.

The stabilizer is to impart strong adhesion force between the coating layer to be formed and the metal substrate, and includes urea and octadecylamine. When the above two components are used as a stabilizer, the coupling force between ruthenium elements included in the coating layer may be significantly improved, and by controlling the oxidation state of particles containing a ruthenium element, an electrode may be manufactured in a form more suitable for an electrolysis reaction.

Meanwhile, the molar ratio between urea and octadecylamine included in the stabilizer may be 90:10 to 10:90, 80:20 to 20:80, 80:20 to 30:70, or 80:20 to 60:40, more preferably 80:20 to 60:40. When the molar ratio between urea and octadecylamine is in the above-described range, the effect of improving performance and durability may be maximized by using urea and octadecylamine in combination.

In addition, in the method for manufacturing an electrode for electrolysis of the present technology, the coating composition may include a ruthenium precursor and a stabilizer at a molar ratio of 100:20 to 100:40, preferably 100:25 to 100:35. When the composition ratio between a ruthenium precursor and a stabilizer is in the above-described range, the effect of controlling the oxidation state of a ruthenium element may be excellent by the stabilizer.

Meanwhile, in the method for manufacturing an electrode for electrolysis of the present technology, the coating composition may further include a cerium precursor. The cerium precursor included in the coating composition is then converted into a cerium oxide, and the formed cerium oxide improves the durability of an electrode for electrolysis, and thus, may minimize the loss of a ruthenium element, which is an active material in a catalyst layer of the electrode for electrolysis, during activation or electrolysis.

More specifically, during the activation or electrolysis of the electrode for electrolysis, particles containing a ruthenium element in the catalyst layer are not changed in structure and become a metallic element or partially hydrated, and then reduced to active species. Also, particles containing a cerium element in the catalyst layer are changed into an acicular structure and act as a protective material which prevents physical separation of the particles containing a ruthenium element in the catalyst layer, resulting in improving the durability of the electrode for electrolysis to prevent the loss of the ruthenium element in the catalyst layer. The cerium oxide includes all types of oxide forms in which a cerium element and an oxygen atom are combined, and may be, particularly, an oxide of (II), (III), or (IV).

The cerium precursor may be used without particular limitation as long as it is a compound capable of forming a cerium oxide, and may be, for example, a hydrate, a hydroxide, a halide, or an oxide of a cerium element, and may be, specifically, one or more cerium precursors selected from the group consisting of cerium (III) nitrate hexahydrate ($Ce(NO_3)_3 \cdot 6H_2O$), cerium (IV) sulfate tetrahydrate ($Ce(SO_4)_2 \cdot 4H_2O$), and cerium (III) chloride heptahydrate ($CeCl_3 \cdot 7H_2O$). When any of the above-listed cerium precursors is used, a cerium oxide may be easily formed.

The molar ratio between a ruthenium element and a cerium element included in the coating composition may be 100:5 to 100:30, preferably 100:10 to 100:20. When the molar ratio between a ruthenium element and a cerium element is in the above-described range, the balance between the durability and the electrical conductivity of a manufactured electrode for electrolysis may be excellent.

In addition, in the method for manufacturing an electrode for electrolysis of the present technology, the coating composition may further include a platinum precursor. The platinum precursor included in the coating composition may be then converted into a platinum oxide, and a platinum element provided by the platinum oxide may act as an active material together with a ruthenium element. In addition, when a platinum oxide and a ruthenium oxide are included together in a coating layer, it is possible to exhibit a further excellent effect in terms of durability and overvoltage of an electrode. The platinum oxide includes all types of oxide forms in which a platinum element and an oxygen atom are combined, and may be, particularly, a dioxide or a tetraoxide.

The platinum precursor may be used without particular limitation as long as it is a compound capable of forming a platinum oxide, and may be, for example, one or more platinum precursors selected from the group consisting of chloroplatinic acid hexahydrate ($H_2PtCl_6 \cdot 6H_2O$), diamine dinitro platinum ($Pt(NH_3)_2(NO)_2$), platinum (IV) chloride ($PtCl_4$), platinum (II) chloride ($PtCl_2$), potassium tetrachloroplatinate ($K_2PtCl_4$), and potassium hexachloroplatinate ($K_2PtCl_6$). When any of the above-listed platinum precursors is used, a platinum oxide may be easily formed.

The molar ratio between a ruthenium element and a platinum element included in the coating composition may be 100:20 to 100:20, preferably 100:5 to 100:15. When the molar ratio between a ruthenium element and a platinum element is in the above-described range, it is preferable in terms of improving durability and reducing overvoltage, and when the platinum element is included less than the above range, durability and overvoltage may be deteriorated, and when included greater than the above range, it is not advantageous in terms of economic feasibility.

In the method for manufacturing an electrode for electrolysis of the present technology, as a solvent of the coating composition, an alcohol-based solvent may be used. When an alcohol-based solvent is used, the above-described components may be easily dissolved, and the coupling force between the components may be maintained even in a step of forming a coating layer after the application of a coating composition. Preferably, at least one of isopropyl alcohol and butoxy ethanol may be used as the solvent, and more preferably, a mixture of isopropyl alcohol and butoxy ethanol may be used. When isopropyl alcohol and butoxy ethanol are mixed and used, uniform coating may be achieved compared to using any one thereof alone.

In the manufacturing method of the present technology, a step of pre-treating the metal substrate may be included before performing the coating step.

The pre-treatment may be performing chemical etching, blasting or thermal spraying on a metal substrate to form irregularities on the surface of the metal substrate.

The pre-treatment may be performed by sand blasting the surface of a metal substrate to form fine irregularities, followed by treating the same with a salt or an acid. For example, the pre-treatment may be performed by forming irregularities on the surface of a metal substrate by sand blasting the surface with alumina, immersing the substrate in a sulfuric acid aqueous solution, and then washing and drying the substrate to form fine irregularities on the surface of the metal substrate.

The applying may be performed by any method known in the art without particular limitation as long as the coating composition may be evenly applied on a metal substrate.

The applying may be performed by any one method selected from the group consisting of doctor blade, die casting, comma coating, screen printing, spray spraying, electrospinning, roll coating, and brushing.

The drying may be performed for 5 minutes to 60 minutes at 50° C. to 300° C., and it is preferable that the drying is performed for 5 minutes to 20 minutes at 50° C. to 200° C.

When the above conditions are satisfied, energy consumption may be minimized while sufficiently removing a solvent.

The heat-treatment may be performed for 1 hour or less at 400° C. to 600° C., and it is preferable that the heat-treatment is performed for 5 minutes to 30 minutes at 450° C. to 550° C.

When the above-described conditions are satisfied, impurities in a catalyst layer may be easily removed while not affecting the strength of a metal substrate.

Meanwhile, the coating may be performed by sequentially repeating the applying, drying, and heat-treating such that ruthenium is 7 g or greater, preferably 7.5 g or greater, based on a ruthenium oxide per unit area ($m^2$) of a metal substrate. That is, a manufacturing method according to another embodiment of the present invention may be performed by applying, drying, and heat-treating the coating composition on at least one surface of a metal substrate, and then repeating coating in which the coating composition is again applied, dried, and heat-treated on the one surface of the metal substrate applied with the coating composition for the first time. When the content of a ruthenium oxide per unit area is in the above-described range, it is possible to implement sufficient electrolysis performance.

Hereinafter, the present invention will be described in more detail with reference to embodiments and experimental embodiments, but the present invention is not limited by the embodiments and experimental embodiments. The embodiments according to the present invention may be modified into other various forms, and the scope of the present invention should not be construed as being limited to the embodiments described below. The embodiments of the present invention are provided to describe the present invention more fully to those skilled in the art.

Materials

In the present embodiment, ruthenium (III) chloride hydrate ($RuCl_3 \cdot nH_2O$) was used as a ruthenium precursor, cerium(III) nitrate hexahydrate ($Ce(NO_3)_3 \cdot 6H_2O$) was used as a cerium precursor, and chloroplatinic acid hexahydrate ($H_2PtCl_6 \cdot 6H_2O$) was used as a platinum precursor. As a solvent for a coating composition, a mixture of 2.375 ml of isopropyl alcohol and 2.375 ml of 2-butoxy ethanol was used. As a metal substrate, a nickel metal (40 mesh) substrate of Ildong Keummangsa Co., Ltd was used.

Pretreatment of Metal Substrate

Before forming a coating layer on the metal substrate, the surface of the substrate to be used in each pf Examples and Comparative Examples was sand-blasted with an aluminum oxide (white alumina, F120) under the condition of 0.4 MPa, and then the substrate was put into a 5 M $H_2SO_4$ aqueous solution heated to 80° C. and treated for 3 minutes, and then washed with distilled water to complete pretreatment.

Example 1

In a mixed solvent of the above materials, 3 mmol of ruthenium (III) chloride hydrate, 0.6 mmol of cerium (III) nitrate hexahydrate, and 0.25 mmol of chloroplatinic acid hexahydrate were sufficiently dissolved for 1 hour, and then 0.5661 mmol of urea and 0.1887 mmol of octadecylamine were added thereto and mixed to prepare a coating composition.

The prepared coating composition was coated on the pre-treated nickel mesh using a brush. Thereafter, the pre-treated nickel mesh coated with the prepared coating composition was dried in a convection-type drying oven of 180° C. for 10 minutes, and then further heat-treated for 10 minutes in an electric heating furnace of 500° C. The coating, drying, and heat-treating processes were additionally performed 9 more times, and finally, heat treatment was performed for 1 hour in an electric heating furnace of 500° C. to manufacture an electrode for electrolysis.

Example 2

An electrode for electrolysis was manufactured in the same manner as in Example 1 except that 0.3774 mmol of urea and 0.3774 mmol of octadecylamine were added in the coating composition.

Example 3

An electrode for electrolysis was manufactured in the same manner as in Example 1 except that 0.1887 mmol of urea and 0.5661 mmol of octadecylamine were added in the coating composition.

Comparative Example 1

An electrode for electrolysis was manufactured in the same manner as in Example 1 except that 0.7548 mmol of urea was added in the coating composition, but not octadecylamine.

Comparative Example 2

An electrode for electrolysis was manufactured in the same manner as in Example 1 except that 0.7548 mmol of octadecylamine was added in the coating composition, but not urea.

Experimental Example 1. Confirmation of Performance of Electrode for Electrolysis Using Half-Cell Test In order to confirm the performance of the electrode manufactured in each of Examples and Comparative Examples, a cathode voltage measurement experiment using a half-cell in chlor-alkali electrolysis was performed. Specifically, by using a 32% NaOH aqueous solution as an electrolyte solution, a Pt wire as a counter electrode, and an Hg/HgO electrode as a reference electrode, the manufactured electrode was immersed in the electrolyte solution, and then was activated for 3 hours under the current density condition of −0.62 A/cm$^2$. Thereafter, according to linear sweep voltammetry using a potentiostat device (WonATech, a multichannel potentiostat), the voltage of the activated electrode was measured under the current density condition of −0.62 A/cm$^2$. The results are shown in Table 1 below.

TABLE 1

| Classifications | Example 1 | Example 2 | Example 3 | Comparative Example 1 | Comparative Example 2 |
|---|---|---|---|---|---|
| Voltage (unit: V) | −1.079 | −1.083 | −1.079 | −1.094 | −1.084 |

From the results above, it has been confirmed that the electrode for electrolysis manufactured through the manufacturing method of the present technology, which exhibited a low overvoltage, has more excellent electrolysis performance. Particularly, the electrode performance of the electrode was significantly superior to that of Comparative Example 1 in which only urea was used as a stabilizer, and the electrode performance thereof was slightly superior to that of Comparative Example 2 in which only octadecylamine was used as a stabilizer.

Experimental Example 2. Confirmation of Durability of Electrode for Electrolysis A ruthenium oxide in a coating layer of an electrode for electrolysis is converted into the form of a metal ruthenium or ruthenium oxyhydroxide ($RuO(OH)_2$) in an electrolysis process, and in a situation in which a reverse current is generated, the ruthenium oxyhydroxide is oxidized to $RuO_4^{2-}$ and eluted in an electrolyte solution. Therefore, it can be evaluated that an electrode has excellent durability the longer it takes to reach conditions under which a reverse current is generated. In light of the above fact, the electrode manufactured in each of Examples and Comparative Examples was activated, and then reverse current generation conditions were created, followed by measuring changes in voltage over time. Specifically, the size of the electrode was 10 mm×10 mm, and under the conditions of a temperature of 80° C. and an electrolyte solution of 32 wt % of a sodium hydroxide aqueous solution, the electrode was activated by electrolysis to generate hydrogen for 20 minutes at a current density of −0.1 A/cm$^2$, for 3 minutes at each of −0.2 A/cm$^2$ and −0.3 A/cm$^2$, and for 30 minutes at −0.4 A/cm$^2$. Thereafter, the time taken for a voltage to reach −0.1 V at 0.05 kA/m$^2$ under the reverse current generation conditions was measured, and relative time of arrival was calculated based on a commercially available electrode (Asahi-Kasei Co., Ltd.). The results are shown in Table 2 below.

TABLE 2

| Classifications | Reference Example (Asahi-Kasei Co., Ltd.) | Example 1 | Example 2 | Example 3 | Comparative Example 1 | Comparative Example 2 |
|---|---|---|---|---|---|---|
| −0.1 V time of arrival | 1 | 9.32 | 5.27 | 6.98 | 3.87 | 6.43 |

From the results above, it has been confirmed that the electrode of an embodiment of the present technology exhibits excellent durability since it takes a long time to reach a reverse current. Particularly, Example 1 in which urea and octadecylamine were used at a ratio of 75:25 exhibited particularly excellent durability, and Comparative Examples in which only one of urea and octadecylamine was used exhibited relatively poor durability compared to that of Example 1.

The invention claimed is:

1. A method for manufacturing an electrode for electrolysis, the method comprising:

applying a coating composition on at least one surface of a metal substrate; and drying and heat-treating the metal substrate coated with the coating composition to form a coating layer, wherein the coating composition includes a ruthenium precursor and a stabilizer, wherein the stabilizer includes urea and octadecylamine, and wherein the urea and the octadecylamine are included at a molar ratio of 80:20 to 60:40.

2. The method of claim 1, wherein the ruthenium precursor and the stabilizer are included at a molar ratio of 100:20 to 100:40.

3. The method of claim 1, wherein the coating composition further comprises a cerium precursor.

4. The method of claim 1, wherein the coating composition further comprises a platinum precursor.

5. The method of claim 1, wherein a solvent of the coating composition is a mixture of isopropyl alcohol and 2-butoxy ethanol.

6. The method of claim 1, wherein the applying, the drying, and the heat-treating are repeatedly performed such that a content of a ruthenium oxide is 7 $g/m^2$ or greater per unit area of the electrode for electrolysis.

7. The method of claim 1, wherein the drying is performed for 5 minutes to 60 minutes at 50° C. to 300° C.

8. The method of claim 1, wherein the heat-treating is performed for 1 hour or less at 400° C. to 600° C.

* * * * *